United States Patent [19]

Sapp et al.

[11] Patent Number: 4,873,736

[45] Date of Patent: Oct. 17, 1989

[54] PILLOW STRUCTURE

[75] Inventors: William M. Sapp; Julia E. Harrell, both of Dalton, Ga.

[73] Assignee: Crown Crafts, Inc., Calhoun, Ga.

[21] Appl. No.: 109,520

[22] Filed: Oct. 19, 1987

[51] Int. Cl.[4] ..... A47G 9/00

[52] U.S. Cl. ..... 5/434; 5/490; 5/437

[58] Field of Search ..... D6/595, 596, 597, 598, D6/599, 600, 601; 5/434, 491, 492, 487, 490, 437, 442

[56] References Cited

U.S. PATENT DOCUMENTS

| | | | |
|---|---|---|---|
| D. 102,328 | 12/1936 | Hanna | D6/596 |
| 823,929 | 6/1906 | Coakley | 5/490 |
| 1,042,439 | 10/1912 | Hosken | 5/490 |
| 1,844,291 | 2/1932 | Markutsis | D6/596 |
| 2,008,285 | 7/1935 | Kraus | 5/490 |
| 2,412,769 | 12/1946 | Easterbrooks . | |
| 2,792,576 | 5/1957 | Coady | 5/437 |
| 2,895,146 | 7/1959 | Lester . | |
| 3,044,517 | 7/1962 | Levi . | |
| 3,109,474 | 11/1963 | Levi . | |
| 3,543,313 | 12/1970 | Schweigert | 5/434 |
| 3,602,928 | 9/1971 | Helzer | 5/490 |
| 3,695,691 | 10/1972 | Putnam . | |
| 3,968,529 | 7/1976 | Levin et al. . | |
| 4,286,345 | 9/1981 | Maher . | |
| 4,309,784 | 1/1982 | Cohen | D6/601 |
| 4,419,779 | 12/1983 | Janesh . | |
| 4,649,582 | 3/1987 | Cho | 5/437 |

FOREIGN PATENT DOCUMENTS

| | | | |
|---|---|---|---|
| 557317 | 5/1957 | Belgium | 5/490 |
| 2951089 | 7/1981 | Fed. Rep. of Germany | 5/490 |
| 785687 | 5/1935 | France | 5/437 |

*Primary Examiner*—Gary L. Smith
*Assistant Examiner*—Eric K. Nicholson
*Attorney, Agent, or Firm*—Burns, Doane, Swecker & Mathis

[57] ABSTRACT

A pillow includes a pillow body having a surface including a first surface portion and a second surface portion. The first and second surface portions are disposed on opposite sides of a plane and the pillow body has a thickness in a direction perpendicular to the plane, the thickness increasing inwardly from the perimeter of the pillow body. A plurality of panels are provided, each having at least three edge sections and being connected along at least one of the edge sections to the pillow body. The panels are movable between a first position disposed to a first side of the plane adjacent the first surface portion and a second position disposed to a second side of the plane adjacent the second surface portion. Means are provided for releasably maintaining the plurality of panels in the positions so that the panels can be freely moved between the positions to orient the panels in various configurations.

16 Claims, 3 Drawing Sheets

Fig. 1a
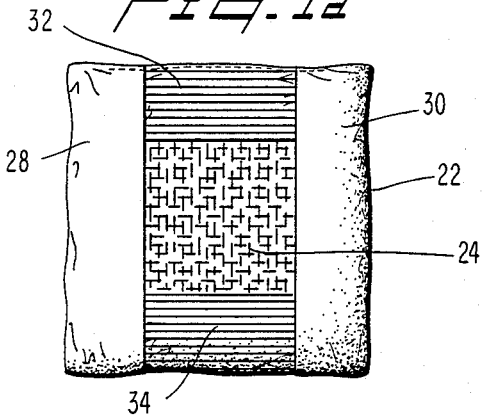
Fig. 1b
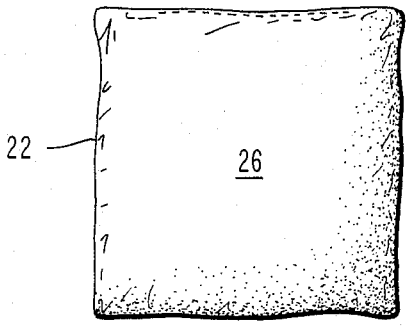
Fig. 2a
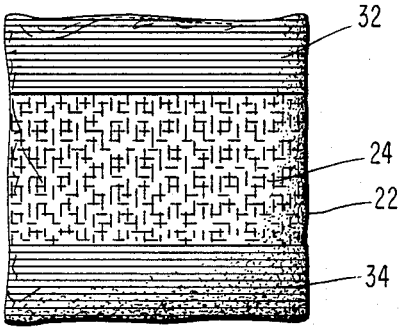
Fig. 2b
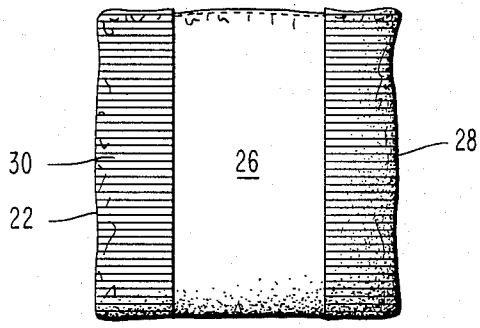
Fig. 3a
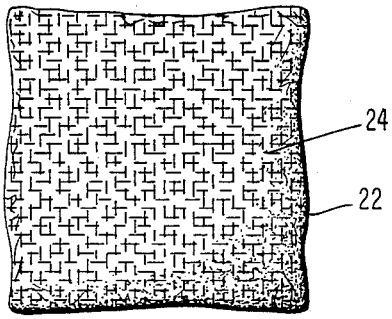
Fig. 3b
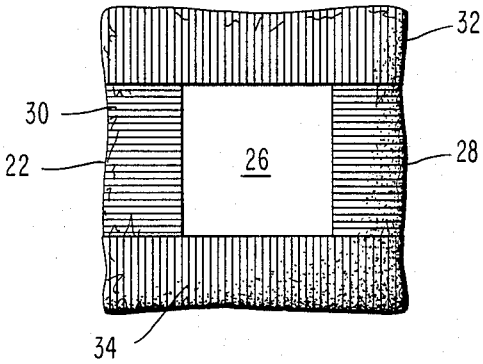
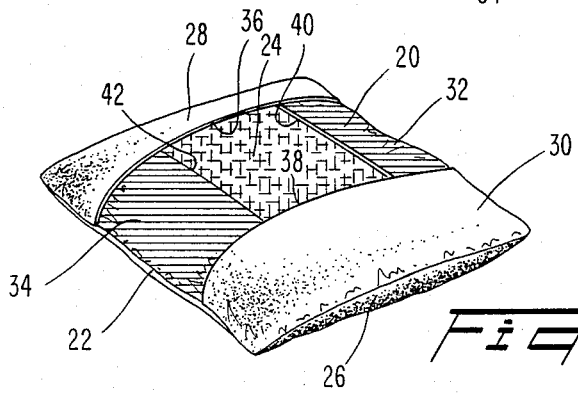
Fig. 4

Fig. 5a
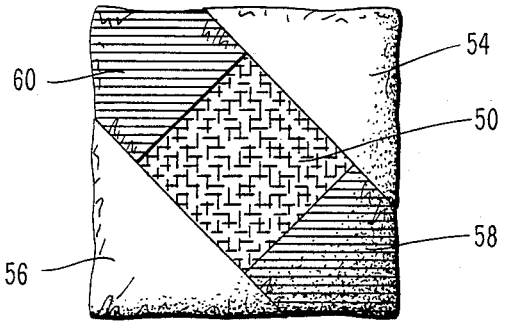
Fig. 5b
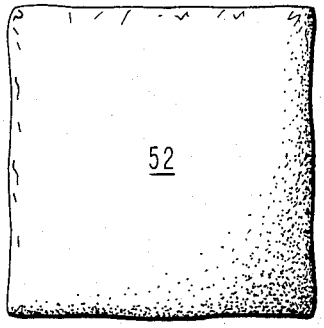
Fig. 6a
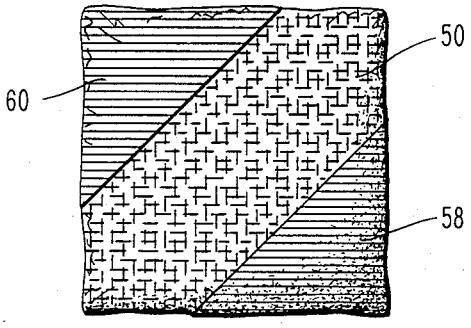
Fig. 6b
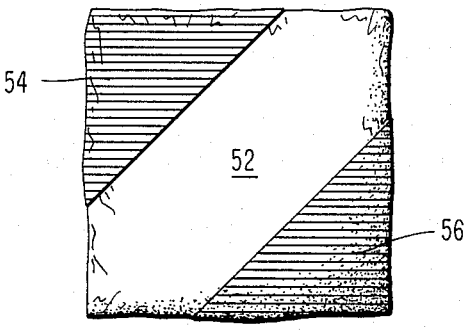
Fig. 7a
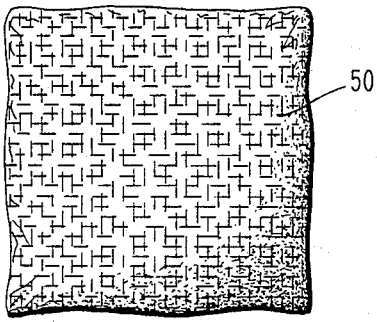
Fig. 7b
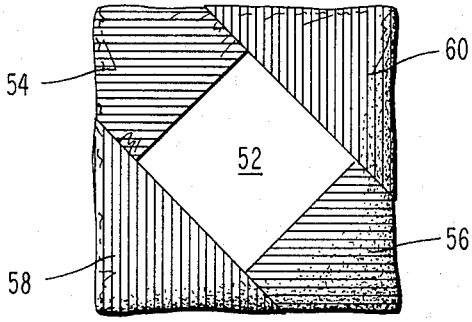
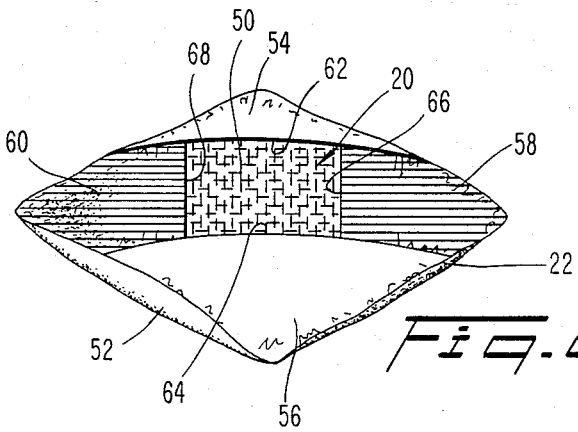
Fig. 8

PILLOW STRUCTURE

BACKGROUND OF THE INVENTION

1. Field of the Invention

The present invention relates generally to pillows and, more particularly, to a pillow structure capable of transformation between a plurality of different design configurations.

2. Description of the Prior Art

It is known to provide a manipulative pillow arrangement including an elongated, thin pillow divided into a plurality of sections which may be folded relative to one another so as to form a generally circular pillow of a decorative design and geometry. Such a pillow arrangement is illustrated e.g. in U.S. Pat. No. 3,968,529, issued on Jul. 13, 1976 to Levin et al. The sections of the pillow arrangement disclosed in that patent can be of different designs or colors so that when the pillow is manipulated, the patterns on the arrangement and thus the overall decorative effect is changed while the geometry of the pillow before and after the manipulation is unchanged.

In such arrangements where the entire pillow is of a geometry different from the final arrangement geometry, it is necessary to compress, stretch, manipulate and fold the pillow body in order to form the pillow into the desired arrangement. As a result, the stuffing of the pillow frequently either becomes compressed so as to be less useful as a cushion or becomes lost or removed from the casing of the arrangement. Thus, the life of such a pillow is shorter than desired since the entire pillow body must be disturbed in order to change the outer design.

It is also known to employ removable pillow casings which may be provided with multiple, reversible, colored panels permitting the casing to be removed and reversed to present a new casing color or design without the need for a separate casing. As with the above-discussed arrangement, reversible pillow casings permit several different designs to be possible in a single arrangement. However, a problem with known removable casings may exist in that the casings, which are easily removable, may also be easily lost. Since it is frequently necessary to remove the casing from the pillow body every time it is desired to change the design, the pillow and the casing can be separated from one another and one of the elements can be lost. In addition, the pillow body may also frequently become dirty and begin to lose its stuffing since it is sometimes handled without a casing.

It is desirable to provide a pillow having the benefits of multiple design possibilities in a single arrangement as exists in the prior art but with the additional benefits of a structure which is durable and which can be frequently manipulated without the need for disassembly of the arrangement or for manipulation of the pillow body itself.

OBJECTS AND SUMMARY OF THE INVENTION

It is an object of the present invention to provide a pillow having a single unitary construction which presents the possibility of having a plurality of different decorative designs and which permits manipulation of the pillow to change the design thereof.

It is a further object of the invention to provide a pillow having a construction which permits manipulation of panels thereon without the necessity of excessively compressing, folding or manipulating the pillow body so that the pillow is capable of being used for a long period of time and of retaining its shape after many manipulations.

These and other objects will be evident from the following description of a preferred embodiment of the invention.

A pillow made in accordance with the present invention includes a pillow body having a surface including a first surface portion and a second surface portion. The first and second surface portions are disposed on opposite sides of a plane, the pillow body having a thickness in a direction perpendicular to the plane, the thickness increasing inwardly from the perimeter of the pillow body. A plurality of panels are provided each having a plurality of edge sections and being connected along at least one of the edge sections to the pillow body. The panels are movable between a first position disposed on a first side of the plane adjacent the first surface portion and a second position disposed on a second side of the plane adjacent the second surface portion. Means are also provided for releasably maintaining the plurality of panels in the positions to which they are moved so that the panels can be freely moved between the positions to orient the panels in various configurations.

By this construction, a pillow is provided which is of a single unitary arrangement and which may be manipulated between any of a plurality of configurations so that the decorative design may be changed without the need for removing the pillow from a casing or without having to excessively fold or manipulate the pillow body.

The construction can take any of several constructions under a preferred form to be discussed below. One such construction includes the use of a plurality of rectangular panels arranged around the perimeter of the pillow while two other constructions include the use of triangular panels.

It is also possible to provide panels which are connected along only one edge to the pillow and which can be tied to another panel so that the panels are maintained in a given configuration.

BRIEF DESCRIPTION OF THE DRAWING

The preferred embodiment of the invention is discussed in the following detailed description which should be considered in connection with the figures in the accompanying drawing, in which:

FIG. 1*a* is a plan view of a first pillow construction according to the preferred embodiment of the invention;

FIG. 1*b* is a backside view of the pillow shown in FIG. 1*a*;

FIG. 2*a* is a plan view of the pillow of FIG. 1*a* with two of the panels moved from their positions in FIG. 1*a* to a position on the backside of the pillow;

FIG. 2*b* is a backside view of the pillow shown in FIG. 2*a*;

FIG. 3*a* is a plan view of the pillow of FIG. 2*a* with the remaining two of the panels moved from their positions in FIG. 2*a* to a position on the backside of the pillow;

FIG. 3*b* is a backside view of the pillow of FIG. 3*a* ;

FIG. 4 is a perspective view of a pillow in accordance with the first construction of the preferred embodiment;

FIG. 5*a* is a plan view of a pillow according to a second construction according to the preferred embodiment of the invention;

FIG. 5*b* is a backside view of the pillow shown in FIG. 5*a*;

FIG. 6*a* is a plan view of the pillow of FIG. 5*a* with two of the panels moved from their positions in FIG. 5*a* to positions on the backside of the pillow:

FIG. 6*a* is a backside view of the pillow of FIG. 6*a*;

FIG. 7*a* is a plan view of the pillow of FIG. 6*a* with the remaining two panels moved to the backside of the pillow;

FIG. 7*b* is a backside view of the pillow of FIG. 7*a*;

FIG. 8 is a perspective view of a pillow of in accordance with the second construction of the preferred embodiment;

DETAILED DESCRIPTION OF A PREFERRED EMBODIMENT

Figure 11:
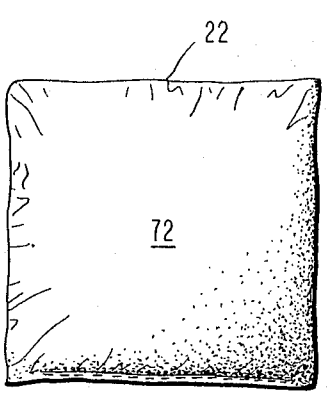
FIG. 11 is a bottom side view of the pillow of FIG. 9.

A first construction according to the preferred embodiment of the invention is shown in FIGS. 1–4. As shown in FIG. 4, the pillow includes a body 20 of generally rectangular shape. A peripheral edge 22 extends around the perimeter of the body 20 and is disposed generally in a plane. As can be seen from the figure, the pillow body 20 has a thickness in a direction perpendicular to the plane in which the edge 22 is located and this thickness increases inwardly from the edge 22. Two surface portions 24, 26 are separated from one another by the peripheral edge 22 each of which may be formed of material having a different design and/or texture than the other.

Four panels 28, 30, 32, 34 are provided and are connected to the peripheral edge 22 of the pillow body 20 in such a way as to permit the panels to be manipulated and moved from a first position disposed on a first side of the plane of the peripheral edge 22 adjacent the first surface portion 24 to a second position disposed on a second side of the pane of the peripheral edge adjacent the second surface portion 26. Each of the panels 28, 30, 32, 34 may be provided with a different design and/or texture on each surface thereof so that when a panel is moved from one position to another, a different decorative design is exposed.

The panels 28, 30, 32, 34 are held in any of the possible positions since they are connected to the peripheral edge along three of four panel edges which are provided on each panel. However, manipulation of the panels is possible with only minor manipulation of the pillow body 20 by grabbing the free edge 36, 38, 40, 42 of one or more of the panels 28, 30, 32, 34 to be moved and pulling the free edge over the peripheral edge 22, thus pulling the entire panel to the other side of the plane of the peripheral edge.

The several different decorative configurations of this first construction of the preferred embodiment are illustrated in FIGS. 1–3. In FIG. 1*a* the pillow is shown substantially as shown in FIG. 4 with all of the panels 28, 30, 32, 34 being arranged adjacent the first surface portion 24. The second surface portion 26 of the arrangement of FIG. 1*a* is shown in FIG. 1*b* and is not covered by any panels in the configuration of FIG. 1*a*.

In FIG. 2*a*, two of the panels 28 and 30 have been manipulated so that they are disposed on the second side of the pillow adjacent the second surface portion 26. As can be seen from FIG. 2*b*, the previously hidden surfaces of the two manipulated panels 28 and 30 are exposed once the panels 28, 30 have been moved to the second position.

All of the panels 28, 30, 32, 34 have been moved to the second position disposed on the second side of the plane in FIGS. 3*a* and 3*b*. Again, the surfaces of the panels which were previously hidden become visible when the panels are moved to the opposite surface portion of the pillow.

A second construction made in accordance with the preferred embodiment of the invention is shown in FIGS. 5–8. The pillow as shown e.g. in FIG. 8 is similar to the pillow in FIGS. 1–4 in that the pillow body 20 is of the same shape and includes a peripheral edge 22 dividing the pillow into two surface portions 50, 52.

However, in this construction, the panels 54, 56, 58, 60 are triangular and are connected to the peripheral edge 22 in a manner which is different from the previously described construction. In this second construction, the triangular panels 54, 56, 58, 60 are connected along two of three panel edges to two adjacent peripheral edge sections. Thus, each panel again is provided with one free edge 62, 64, 66, 68 respectively, which is exposed for grabbing so that the panels 54, 56, 58, 60 can be easily moved from one position disposed to a first side of the plane of the peripheral edge 22 adjacent the first surface portion 50 to a second position disposed to a second side of the plane of the peripheral edge 22 adjacent the second surface portion 52. The manner in which this manipulation affects the design of the pillow is shown in FIGS. 5–7.

Figure 9:
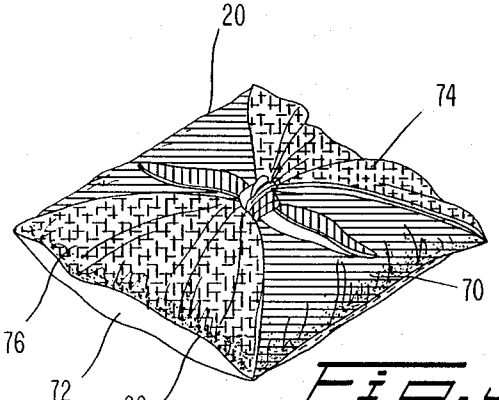
FIG. 9 is a perspective view of the pillow according to a third construction in accordance with the preferred embodiment of the invention.

In FIG. 9 there is shown a third construction made in accordance with the preferred embodiment of the invention. The pillow according to this construction is not unlike the pillow of the previously discussed two constructions in that the pillow body 20 is of a rectangular shape and is provided with a peripheral edge 22 which extends in a plane around the pillow body 20 to divide the body into two surface portions 70, 72.

Figure 10:
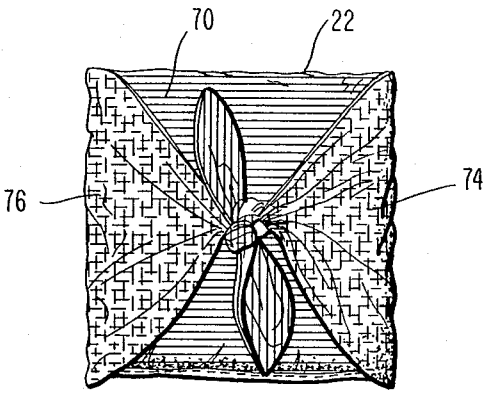
FIG. 10 a plan view of the pillow of FIG. 9.

Two panels 74, 76 are provided on the arrangement each being of a triangular shape. One edge of each panel is connected to an edge section of the peripheral edge 22 of the pillow so that two of the edges of each panel 74, 76 are free. The panels are thus loose and capable of being tied together adjacent either surface 70, 72 of the pillow. A top view of the pillow with the panels 74, 76 tied together adjacent the first surface portion 70 is shown in FIG. 10. The panels 74, 76 may have a different colored and/or textured surface on each side thereof to permit a variation in the design of the arrangement when the panels are tied together adjacent the second surface portion 72.

FIG. 11 illustrates the second surface portion 72 of the pillow shown in FIG. 10. The second surface portion can be formed of a material having a different color and/or texture than the first surface portion 70 to permit the result of having a variable colored or textured pillow.

Figure 12:
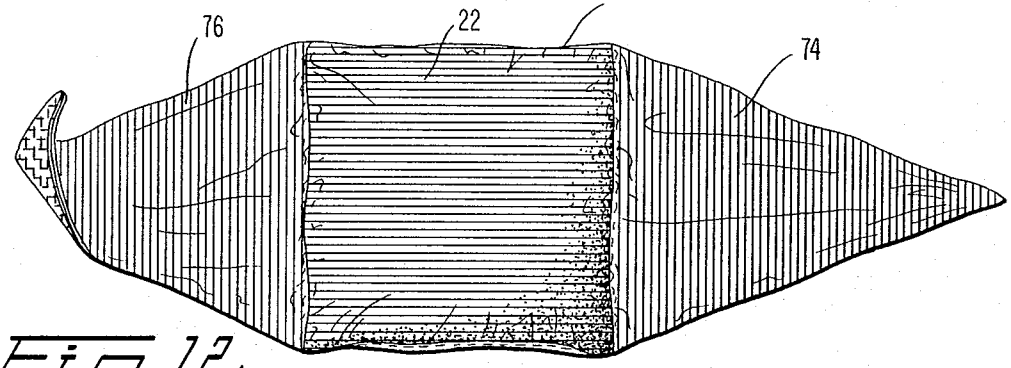
FIG. 12 is a plan view of the pillow of FIG. 9 with the panels shown untied from one another.
Figure 13:
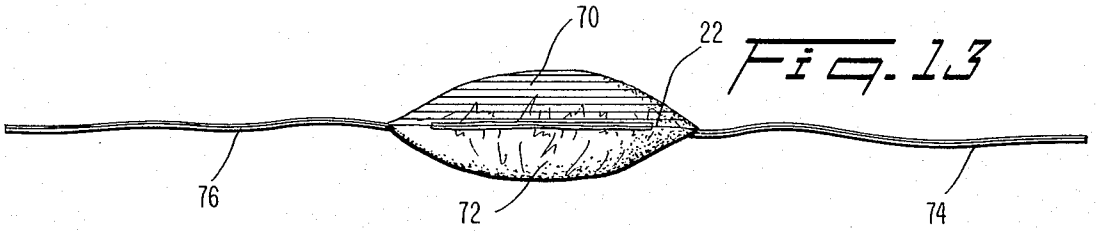
FIG. 13 is a side view of the pillow of FIG. 9 with the panels shown untied from one another.

In FIGS. 12 and 13, the pillow is shown with the panels 74, 76 untied so that the manner in which the panels are connected to the peripheral edge 22 can be clearly seen. Although it is not shown in the figures, it should be noted that the number of panels which may be attached to the peripheral edge of the pillow is not limited to two or four panels. There is no significance to the number of panels shown herein with respect to any of the constructions of the preferred embodiment. In addition, there is nothing to prevent a circular or other shaped pillow from being used in the invention.

While this invention has been illustrated and described in accordance with a preferred embodiment, it is recognized that variations and changes may be made and equivalents employed herein without departing from the invention as set forth in the claims.

What is claimed is:

1. A pillow comprising:

a pillow body having a surface including a first surface portion and a second surface portion, said first and second surface portions being disposed on opposite sides of a plane, said pillow body having a thickness in a direction perpendicular to the plane, said thickness increasing inwardly from the perimeter of the pillow body;

a plurality of panels each having a plurality of edge sections and being connected along at least two of said edge sections to said pillow body, each of said panels being movable between a first position disposed on a first side of the plane adjacent said first surface portion and a second position disposed on a second side of the plane adjacent said second surface portion, each of said plurality of panels covering less than one-half of said first surface portion when each of said panels is positioned in said first position and covering less than one-half of said second surface portion when each of said panels is positioned in said second position; and means for releasably maintaining said plurality of panels in said first and second positions so that the panels can be freely moved between the positions to orient the panels in various configurations.

2. The pillow according to claim 1, wherein the perimeter of the pillow body generally defines a rectangle in the plane such that the perimeter is divided into four perimeter sections.

3. The pillow according to claim 2, wherein each panel is of a rectangular shape having four panel edges and a dimension of length equal to the length of one of said perimeter sections, said panel being connected to said pillow body both along an intersection between the one perimeter section and one of said panel edges extending along the length of the panel and along intersections between the two perimeter sections adjacent the one perimeter section and the two panel edges adjacent the one panel edge section.

4. The pillow according to claim 2, wherein each panel is of a triangular shape having three panel edges, each of said panels being connected along two of said panel edges to the pillow body adjacent two of said perimeter sections.

5. A pillow comprising:

a pillow body having a surface and a peripheral edge extending around said body dividing said surface into a first surface portion and a second surface portion, said peripheral edge being disposed generally in a plane and said pillow body having a thickness in a direction perpendicular to the plane in which said edge is located, said thickness increasing inwardly from said edge;

a plurality of panels each having at least three edge sections and being connected along at least two of said edge sections to said peripheral edge, each of said panels being movable between a first position disposed to a first side of the plane of the peripheral edge adjacent said first surface portion and a second position disposed to a second side of the plane of the peripheral edge adjacent said second surface portion, each of said plurality of panels covering less than one-half of said first surface portion within each of said panels is positioned in said first position and covering less than one-half of said second surface portion when each of said panels is positioned in said second position; and means for releasably maintaining said plurality of panels in said first and second positions so that the panels can be freely moved between the positions to orient the panels in various configurations.

6. The pillow according to claim 5, wherein said peripheral edge generally defines a rectangle in the plane of the edge such that the peripheral edge is divided into four peripheral edge sections.

7. The pillow according to claim 6, wherein each panel is of a rectangular shape having four panel edges and a dimension of length equal to the length of one of said peripheral edge sections, said the panel being connected to said peripheral edge both along an intersection between the one peripheral edge section and one of said panel edges extending along the length of the panel and along intersections between the two peripheral edge sections adjacent the one peripheral edge section and the two panel edges adjacent the one panel edge section.

8. The pillow according to claim 6, wherein each panel is of a triangular shape having three panel edges, each of said panels being connected along two of said panel edges to two of said peripheral edge sections of the peripheral edge.

9. The pillow according to claim 1, wherein each of said plurality of panels is substantially rectangularly shaped and each of said substantially rectangularly shaped panels has three edge sections connected to a periphery of said pillow body and a fourth edge section that is not connected to the periphery of said pillow body.

10. The pillow according to claim 9, wherein two of said edge sections are connected to the periphery of said pillow body along opposite sides of said pillow body, said two edge sections each extending along less than one-half of the length of the respective side of the pillow body to which it is connected.

11. The pillow according to claim 1, wherein each of said plurality of panels is substantially triangularly shaped and each of said substantially triangularly shaped panels has two edge sections that are connected to a periphery of said pillow body and third edge section that is not connected to the periphery of said pillow body.

12. The pillows according to claim 11, wherein said two edge sections that are connected to the periphery of said pillow body are each connected to sides of said pillow body that meet to form a corner, the length of each of said edge sections that is connected to a side of the pillow body being less than the length of the sides of the pillow body to which the edge sections are respectively connected.

13. The pillow according to claim 5, wherein each of said plurality of panels is substantially rectangularly shaped and each of said substantially rectangularly shaped panels has three edge sections connected to the peripheral edge of said pillow body and a fourth edge section that is not connected to the peripheral edge of said pillow body.

14. The pillow according to claim 13, wherein two of said edge sections are connected to the peripheral edge of said pillow body along opposite sides of said pillow body, said two edge sections each extending along less than one-half of the length of the respective side of the pillow body to which it is connected.

15. The pillow according to claim 5, wherein each of said plurality of panels is substantially triangularly shaped and each of said substantially triangularly shaped panels has two edge sections that are connected to the peripheral edge of said pillow body and a third edge section that is not connected to the peripheral edge of said pillow body.

16. The pillow according to claim 15, wherein said two edge sections that are connected to the peripheral edge of said pillow body are each connected to side of said pillow body that meet to form a corner, the length of each of said edge sections that is connected to a side of the pillow body being less than the length of the sides of the pillow body to which the edge sections are respectively connected.

* * * * *